US006149403A

United States Patent [19]

Van Davelaar et al.

[11] Patent Number: 6,149,403

[45] Date of Patent: Nov. 21, 2000

[54] PUMP DRIVE DECOUPLER

[75] Inventors: Peter C. Van Davelaar, Maidens; Jeffrey A. Horsman, Charlottesville, both of Va.

[73] Assignee: Dyax Corporation, Cambridge, Mass.

[21] Appl. No.: 09/260,915

[22] Filed: Mar. 2, 1999

[51] Int. Cl.[7] ..... F04B 9/00

[52] U.S. Cl. ..... 417/319; 417/415; 417/53; 60/399; 60/403

[58] Field of Search ..... 417/319, 223, 417/53, 269, 415; 60/399, 403

[56] References Cited

U.S. PATENT DOCUMENTS

| | | | |
|---|---|---|---|
| 3,033,381 | 5/1962 | Noble et al. | 294/2 |
| 3,922,115 | 11/1975 | Coe et al. | 417/374 |
| 4,121,865 | 10/1978 | Littwin, Sr. | 294/2 |
| 4,797,834 | 1/1989 | Honganen et al. | 364/510 |
| 4,900,683 | 2/1990 | Metzger et al. | 436/179 |
| 5,632,606 | 5/1997 | Jacobsen et al. | 417/415 |
| 5,845,950 | 12/1998 | Stowe et al. | 294/65.5 |
| 5,865,487 | 2/1999 | Gore et al. | 294/2 |

OTHER PUBLICATIONS

Biotage brochure, Parallex HPLC, "Parallel Purification for Combinatorial Chemistry" Jan. 1996.

*Primary Examiner*—Charles G. Freay
*Assistant Examiner*—Robert Z. Evora
*Attorney, Agent, or Firm*—Fish & Richardson P.C.

[57] ABSTRACT

A pump drive assembly is disclosed. The assembly includes a driver, a pump drive member driven by the driver, and a decoupler that decouples the drive member from the driver when a force acting upon the drive member exceeds a threshold force. The pump drive member can be a piston rod, and the decoupler can be a magnet attached to the piston rod and coupled to a magnetically attracted plate driven by the driver. When a force resisting movement of the piston rod exceeds the magnetic force coupling the magnet to the plate, the magnet decouples from the plate, and the pumping operation ceases.

22 Claims, 8 Drawing Sheets

PUMP DRIVE DECOUPLER

BACKGROUND OF THE INVENTION

The invention relates to pump assemblies.

Different types of pump assemblies can be used to deliver a fluid or gas from a source to a destination. Typically, a pump assembly will include a pumping device, such as a piston or a diaphragm, and tubing connecting the pump to a fluid or gas source and to a desired destination. If a clog or obstruction forms, for example, in the tubing, the pump may not function properly, or the tubing may rupture.

SUMMARY OF THE INVENTION

In general, in one aspect, the invention features a pump drive assembly including a driver, a pump drive member driven by the driver, and a decoupler that decouples the drive member from the driver when a force acting upon the drive member exceeds a threshold force.

Embodiments of this aspect of the invention may include one or more of the following features. The pump drive assembly includes a pumping member, such as a piston head, and the drive member is a piston rod. Alternatively, the pumping member can be a different type of positive displacement pump, such as a diaphragm. The decoupler couples to a decoupler attachment structure driven by the driver. The decoupler attachment structure includes a magnetizable material, such as iron, stainless steel, steel, or a ceramic including a magnetizable material, and the decoupler is a magnet.

The drive member includes a structure for coupling the drive member to the magnet. For example, the magnet defines a bore, the drive member is constructed to be insertable within the bore, and the drive member has a structure for retaining the drive member within the bore. Alternatively, the magnet defines an opening, and the drive member includes a structure insertable within the opening. The magnet can be a permanent magnet or an electromagnet.

The magnet is coupled to the decoupler attachment structure by a magnetic force of, e.g., between 10 and 100 pounds, preferably between 30 and 70 pounds. The magnetic force coupling the magnet and the decoupler attachment structure is approximately equal to the threshold force.

Instead of using magnetic force, the decoupler can couple to the decoupler attachment structure using various mechanical fasteners. For example, the decoupler has a first face having one of hook portions or loop portions of hook and loop fasteners, and the decoupler attachment structure has a first face having the other of hook portions or loop portions of hook and loop fasteners. Alternatively, the decoupler includes a first piece, a second piece, and a coupling structure, such as a latch, which releasably attaches the first piece to the second piece when the force acting upon the drive member exceeds the threshold force. The decoupler can also include a deformable structure that deforms when the force acting upon the drive member exceeds the threshold force, decoupling the decoupler from the drive member.

The force acting upon the drive member is a resistive force resisting movement of the drive member in a pumping direction. For example, the pump displaces fluid or gas, and the force acting upon the drive member is the force exerted by the displaced fluid or gas upon the positive displacement pump.

The assembly can include a plurality of drive members driven by the driver, and a plurality of decouplers. Each decoupler decouples a single drive member from the driver when a force acting upon the single drive member exceeds a threshold force. When the single drive member decouples, the driver continues to drive additional drive members. The decouplers can be magnets attracted to a plate driven by the driver. Each drive member is connected to a separate magnet, and each magnet is coupled to the plate by magnetic force. The plate includes a first surface closer to the driver, and a second surface further from the driver. The magnets are coupled to the second surface, and the plate defines holes for passage of the drive members therethrough.

The driver can be a pneumatic drive, a hydraulic drive, or an electric motor drive.

Preferably the pump assembly is used to supply mobile phase liquid to a plurality of chromatography columns connected in parallel. The outlets of the chromatography columns are connected to a fraction collector to collect sequential samples from each column.

In general, in another aspect, the invention features a method of ceasing a pumping operation upon exceeding a threshold resistance to the pumping operation. The method includes providing a driver, a pump drive member driven by the driver, a decoupler connecting the pump drive member to the driver, and a pump driven by the pump drive member. The method further includes pumping fluid in the pump by the driver and drive member so long as pressure in the fluid pumped by the pump is below a threshold value. If the pressure exceeds the threshold value, the decoupler decouples from the driver.

In general, in another aspect, the invention features a method of ceasing one of a plurality of pumping operations upon exceeding a threshold resistance to the one pumping operation. The method includes providing a driver, a plurality of pump drive members driven by the driver, a plurality of decouplers connecting the pump drive members to the driver, and a plurality of pumps driven by respective pump drive members. The method further includes pumping fluids in the pumps by the driver and drive members so long as pressure in the fluids pumped by the pumps is below a threshold value, and decoupling a decoupler from the driver when pressure in a fluid exceeds the threshold value.

Embodiments of this aspect of the invention may include one or more of the following features. The fluid is mobile phase liquid for chromatography, and the method further includes directing the liquid through respective chromatography columns, and directing liquid from the chromatography columns to a fraction collector. The method further includes continuing pumping at pumps whose associated drive members have not been decoupled.

Embodiments of the invention may include one or more of the following advantages. The pump drive member automatically decouples from the driver and stops pumping fluid or gas when a clog or obstruction develops. Cessation of pumping when an obstruction develops reduces the risk that tubing will disengage or rupture, damaging components or potentially exposing the user to harmful chemicals.

The assembly allows multiple pumps to deliver fluid or gas to multiple destinations. If a single pump line becomes obstructed, only the affected pump drive member decouples, and the remaining pumps continue to deliver fluid or gas normally. The affected line can be unclogged or cleaned without disassembling the pump assembly or ceasing all pumping.

The assembly can pump different fluids or gasses simultaneously.

The decoupler is easily adjustable, allowing the decoupler to disengage at different predetermined threshold resistive forces (e.g., by use of non-magnetic shims).

Other features and advantages of the invention will be apparent from the following description and from the claims.

DESCRIPTION OF THE PREFERRED EMBODIMENTS

Figure 1:
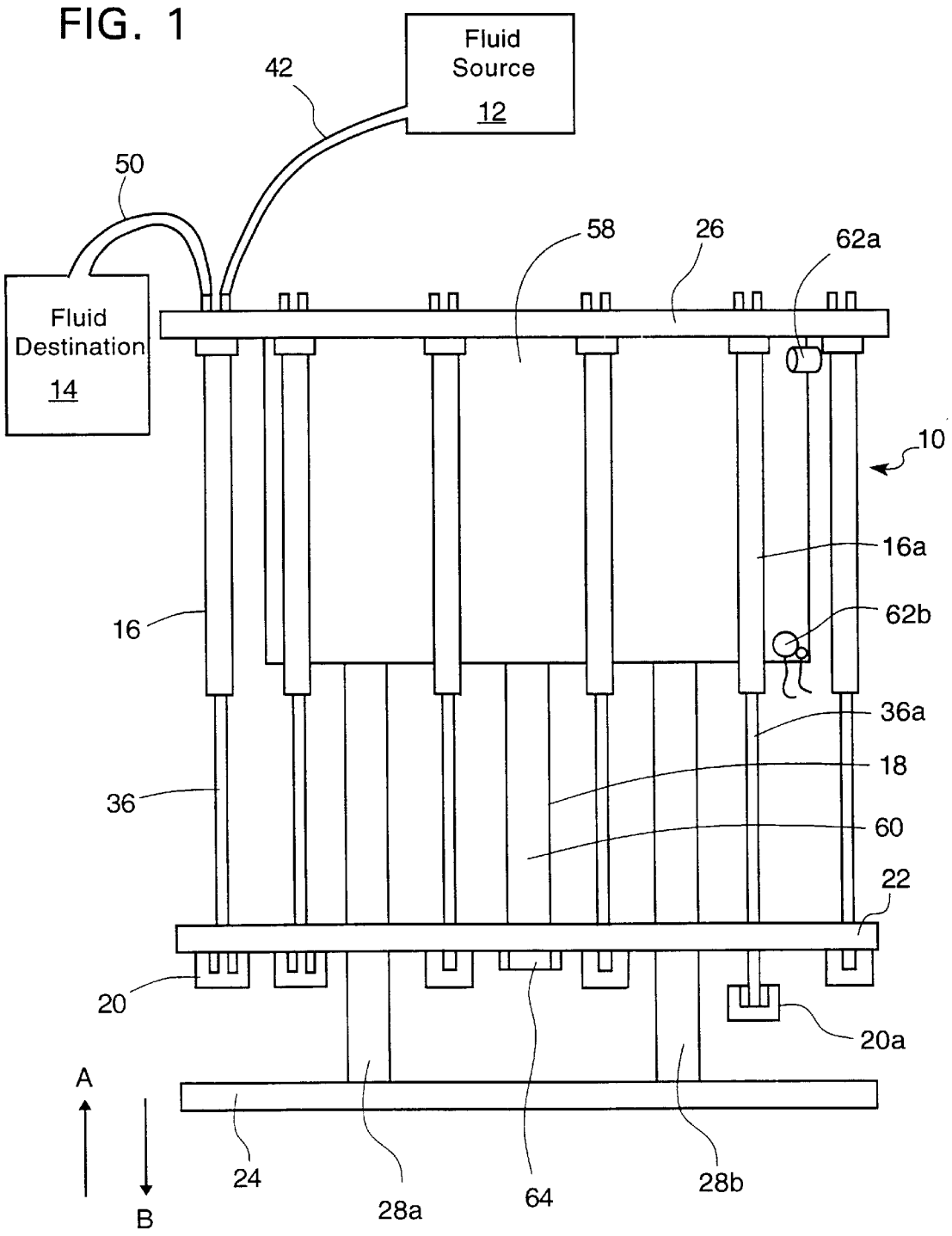
FIG. 1 is a diagrammatic elevation of a pump drive assembly.
Figure 2:
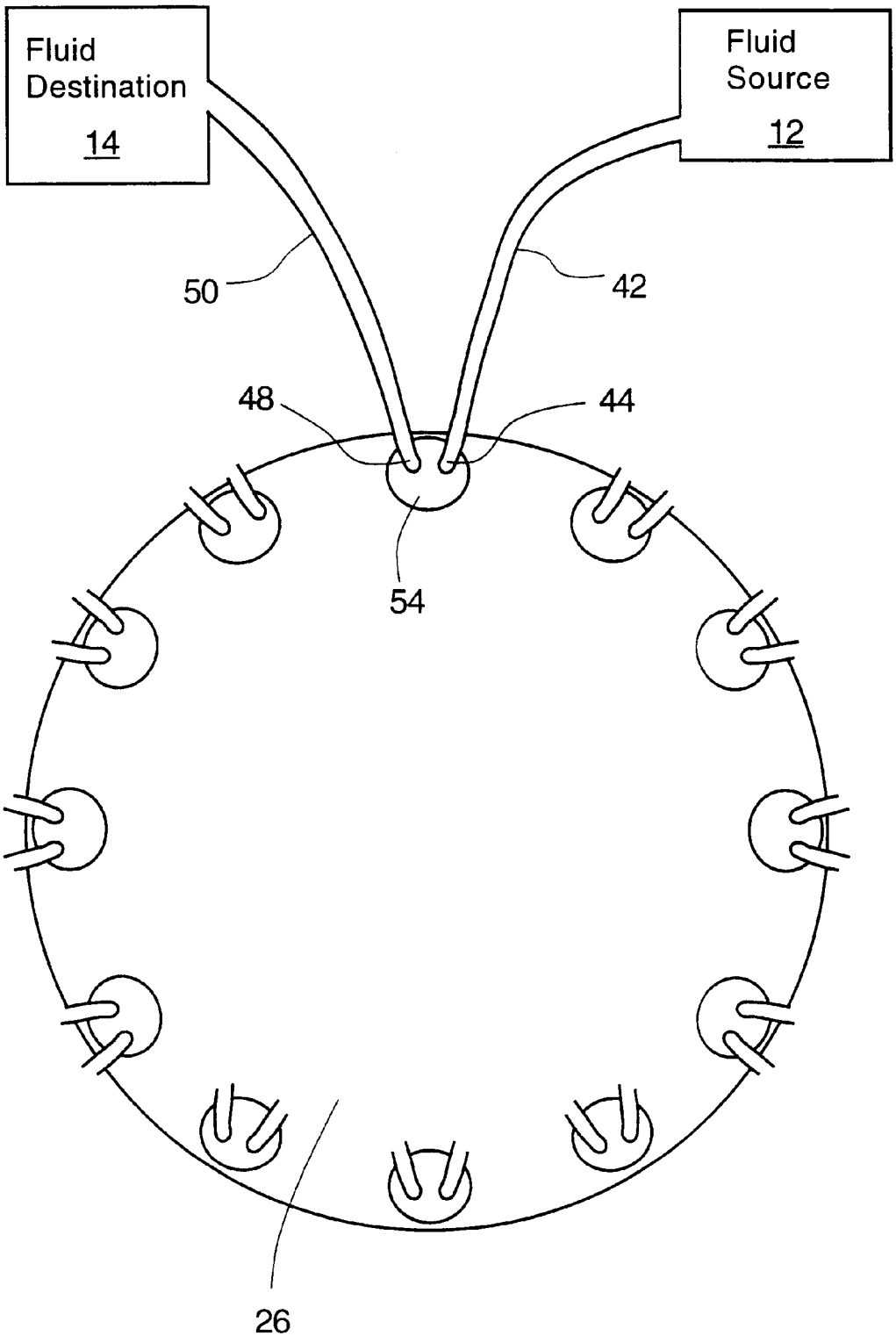
FIG. 2 is a plan view of the assembly of FIG. 1.

Referring to FIGS. 1 and 2, pump drive assembly 10 can be used to pump fluid from a fluid source 12 to multiple fluid destinations 14 (only one destination shown). Assembly 10 includes twelve pumps 16, a driver 18, twelve permanent magnets 20, an iron plate 22, a base 24, a top plate 26, and support posts 28*a*, 28*b*.

Figure 3:
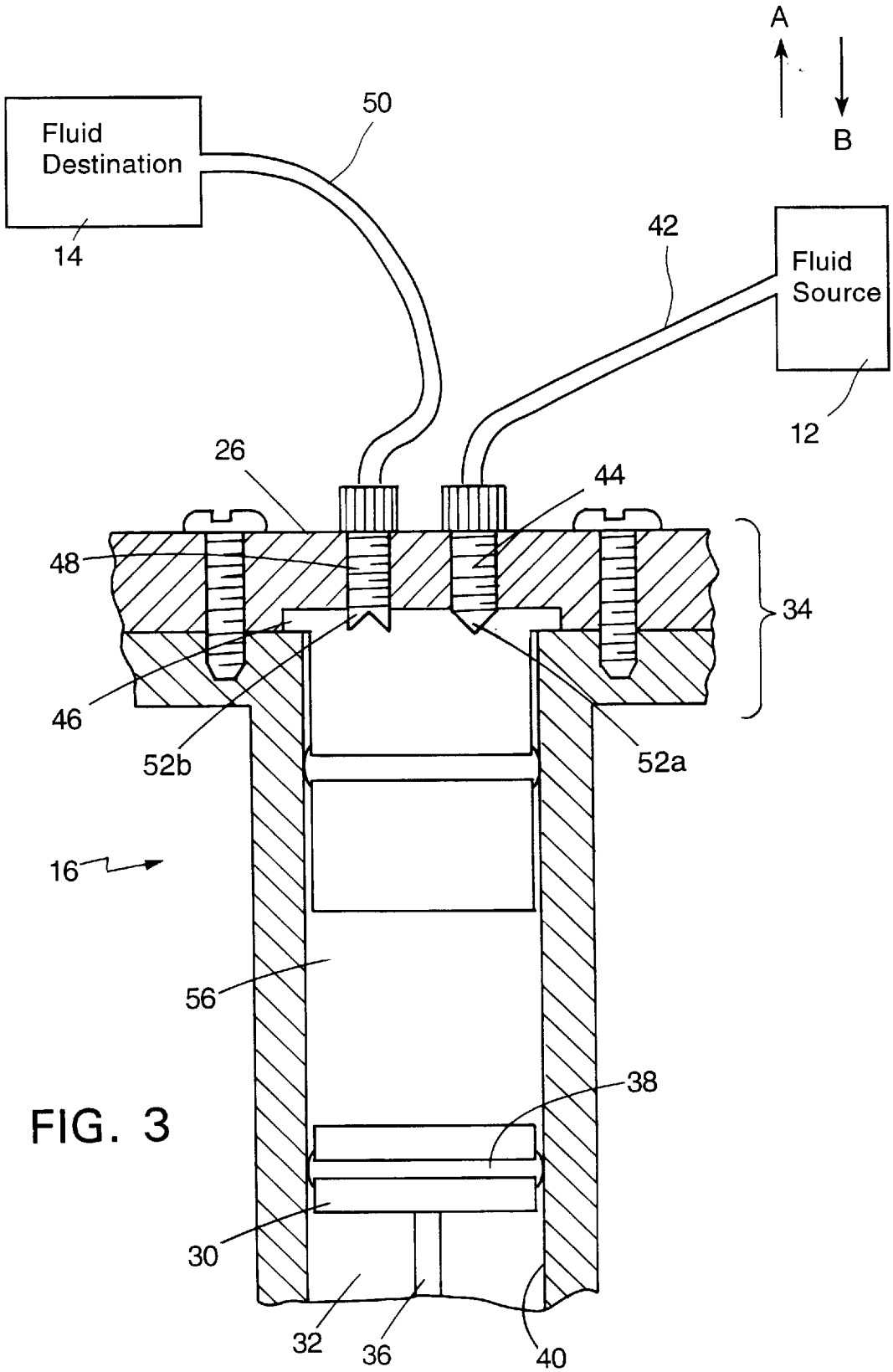
FIG. 3 is an enlarged, partial sectional view of a pump of the assembly of FIG. 1.

Referring to FIG. 3, each individual pump 16 includes a piston 30, a pump cylinder 32, and an inflow/outflow assembly 34. Piston 30 includes a piston rod 36 and a piston head 38. Head 38 is generally cylindrical in shape, and has a diameter approximately equal to the inner diameter of pump cylinder 32. Head 38 fits snugly within cylinder 32, forming an air-tight seal with an inner wall 40 of cylinder 32. Head 38 is slidable within cylinder 32 in the directions of arrows A and B.

Inflow/outflow assembly 34 includes an inflow tube 42, an inflow channel 44, a check valve 46 module, an outflow channel 48, and an outflow tube 50. Inflow tube 42 connects fluid source 12 to inflow channel 44, and outflow tube 50 connects outflow channel 48 to a fluid destination 14, preferably a chromatography column, as described below. Check valve module 46 has two one-way conduits, one-way inflow conduit 52*a*, and one-way outflow conduit 52*b*. The structure and operation of check valve module 46 is described in co-pending U.S. patent application Ser. No. 09/260,914 entitled "Check Valve Module," filed the same date as this application, and incorporated by reference herein in its entirety. Inflow/outflow assembly 34 may include a connecting piece 54 (FIG. 2) mounted in top plate 26 to support and provide access for the inflow and outflow channels 44 and 48; alternatively, and preferably, these components can be integrally supported by top plate 26. Piece 54, and the manner in which piece 54 or the integral portion of top plate 26 couples to check valve module 46, is described in U.S. patent application Ser. No. 09/260,916, entitled "Fluid Coupling Assembly and Method," filed the same date as this application, and incorporated herein by reference in its entirety.

Each pump 16 delivers fluid from fluid source 12 to a destination 14 in the following manner. Piston 30 is first moved in the direction of arrow B, drawing fluid from fluid source 12 through inflow tube 42, through channel 44, through inflow conduit 52*a*, and into a fluid chamber 56 within pump cylinder 32. Piston 30 is then moved in the direction of arrow A, forcing the liquid in chamber 56 through outflow conduit 52*b*, through channel 48, through outflow tube 50, and to fluid destination 14.

Referring again to FIG. 1, top plate 26, bottom 24, and iron plate 22 are generally circular in shape. Support posts 28*a*, 28*b* connect top 26 to bottom 24. Plate 22 defines holes (not shown) for passage of posts 28*a*, 28*b* therethrough. Pumps 16 are arranged in a circle about top plate 26.

Driver 18 includes a pneumatic drive 58, and a driving bar 60. Pneumatic drive 58 has air ports 62*a*, 62*b*. Bar 60 is attached to plate 22 at a bolt 64, and connects plate 22 to pneumatic drive 58. By, e.g., forcing air into or out of air ports 62*a*, 62*b*, pneumatic drive is capable of forcing bar 60 and plate 22 in the direction of arrow A or in the direction of arrow B.

Figure 4:
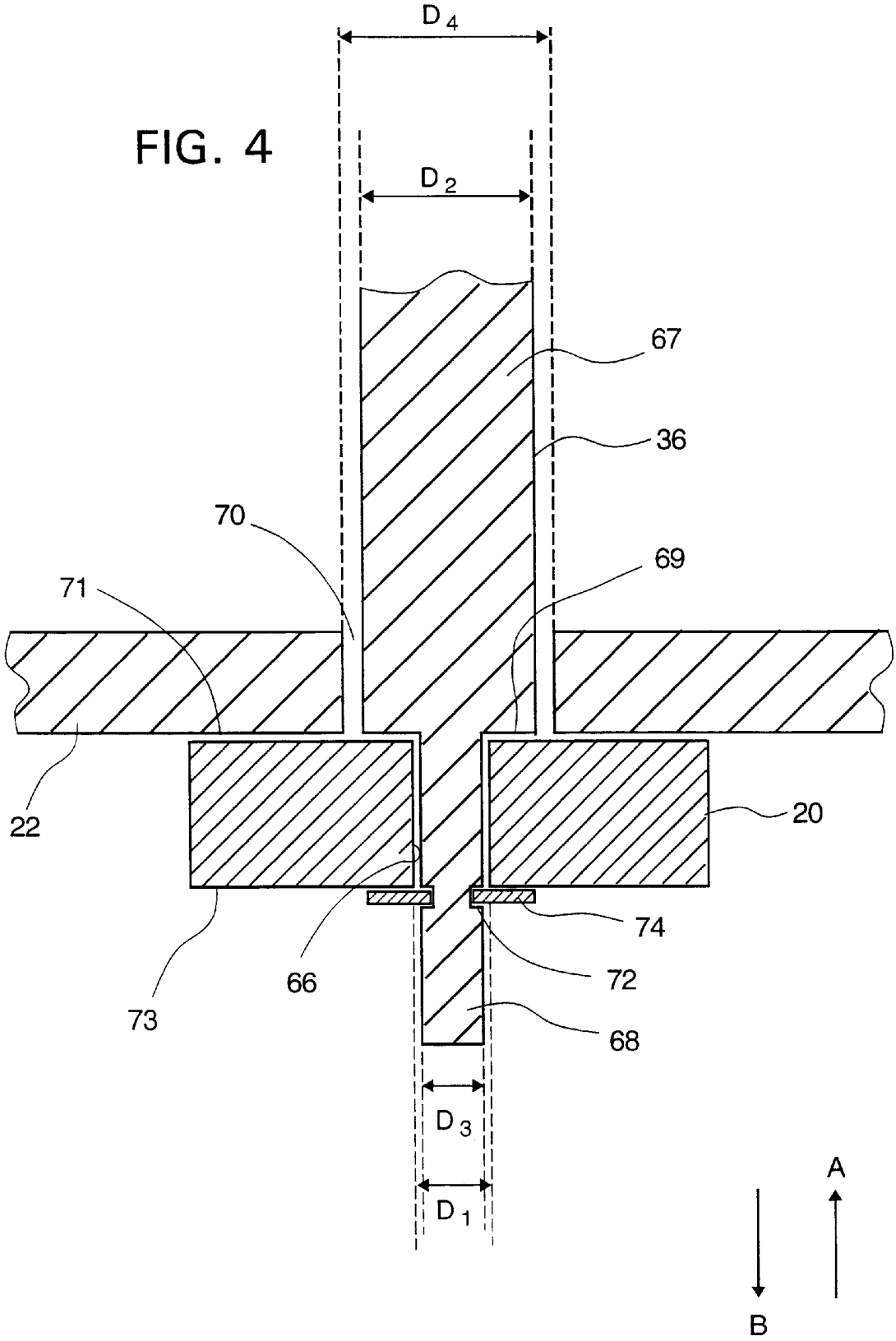
FIG. 4 is an enlarged sectional view of a decoupler of the assembly of FIG. 1.

Referring to FIG. 4, each piston rod 36 is coupled to plate 22 and, therefore, to pneumatic drive 58 (FIG. 1), by a permanent magnet 20. Each magnet 20 defines a cylindrical bore 66, having a diameter $D_1$. Each piston rod 36 has a wide region 67, a narrow region 68, and a shelf 69 at the juncture of wide region 67 and narrow region 68. Each wide region 67 has a diameter $D_2$ greater than the diameter $D_1$ of bore 66, and each narrow region 68 has a diameter $D_3$ less than diameter $D_1$. Plate 22 also defines twelve cylindrical holes 70, each hole having a diameter $D_4$ which is greater than diameter $D_2$ of wide regions 67. Wide regions 67 of rods 36 pass through holes 70, and narrow regions 68 pass through bores 66. Shelf 69 abuts an upper side 71 of magnet 20. Diameter $D_1$ is, e.g., about 0.375 inches; diameter $D_2$ is, e.g., about 0.44 inches; diameter $D_3$ is, e.g., about 0.350 inches; and diameter $D_4$ is, e.g., about 0.48 inches.

Each narrow region 68 also has a groove 72 just below a lower side 73 of magnet 20. A retaining ring 74 is fit within each groove 72. Rings 74 abut lower sides 73 of magnets 20, and couple magnets 20 to rods 36.

Each magnet 20 is attracted to iron plate 22 by a magnetic force of, e.g., about 30 pounds. If, therefore, a shelf 69 exerts a force upon a magnet 20 in the direction of arrow Y greater than, e.g., about 30 pounds, the magnet 20 will decouple from plate 22. A shelf 69 might exert such a force if, e.g., a clog develops within an outflow tube 50, as described below.

In operation, a user first couples inflow tubes 42 to inflow channels 44, and couples outflow tubes 50 to outflow channels 48. The user attaches magnets 20 to a bottom side 74 of plate 22, and passes narrow regions 68 of rods 36 through bores 66 of magnets 20. Retaining rings 74 are slid into grooves 72, coupling magnets 20 to rods 36. (Alternatively, and preferably, these assembly operations can be performed at the factory.) The user then activates pneumatic pump 58, forcing bar 60 and plate 22 downward, in the direction of arrow B. Forcing plate 22 downward causes magnets 20 to exert a downward force on retaining rings 74. The downward force on rings 74 pulls pistons 30 downward, causing chambers 56 in pump cylinders 32 to expand and fill with liquid from liquid source 12, as described above.

Once chambers 56 have expanded and filled with a desired volume of liquid, e.g., 12 ml per pump, a limit switch activates a four-way valve (both not shown) to reverse pump direction in the direction of arrow A. The upward movement of pneumatic drive 58 pulls bar 60, plate 22, and magnets 20 upward. Magnets 20 push shelves 69 of rods 36 upward, which pushes pistons 30 upward, forcing liquid in chambers 56 towards liquid destination 14, as described above.

As pistons 30 move upward and push liquid out of chambers 56, pistons 30 will encounter a resistive force due to pressure exerted upon piston heads 38 by the liquid. The resistive force will be downward, in the direction of arrow B. The resistive force exerted upon pistons 30 causes shelves 69 of rods 36 to exert a downward force on upon magnets 20.

If the downward resistive force on a particular magnet 20 is greater than 30 pounds, the net force on the magnet 20 in the direction of arrow B (the downward resistive force plus the force of gravity) will be greater than the net force on the magnet 20 in the direction of arrow A (the attractive force between magnet 20 and plate 22), and the magnet 20 will decouple from plate 22. In FIG. 1, a magnet 20*a* associated with a rod 36*a* and a pump 16*a* is shown decoupled from plate 22.

Excessive resistive force and subsequent decoupling of magnet 20*a* from plate 22 can be caused by, e.g., a clog or blockage in tube 50, channel 44, check valve module 46, or fluid destination 14.

Once magnet 20*a* decouples from plate 22, piston 30 stops moving upward and stops forcing liquid out of chamber 56. Because piston head 38 forms a tight seal with wall 40 of pump cylinder 32, piston 30 does not fall in the direction of arrow B after magnet 20*a* decouples. Rod 36*a* and magnet 20*a*, therefore, remain in the location at which they decoupled.

After the still coupled pumps 16 complete delivery of the desired volumes of liquid to destinations 14, assembly 10 typically automatically continues to pump further sets of desired volumes of liquid. When pneumatic pump 58 again moves in the downward direction, plate 22 will recouple with magnet 20*a* when plate 22 returns to the point at which magnet 20*a* decoupled. If the clog or failure which caused magnet 20*a* to decouple has been remedied, then magnet 20*a* will remain coupled, and pump 16*a* will operate normally.

Figure 7:
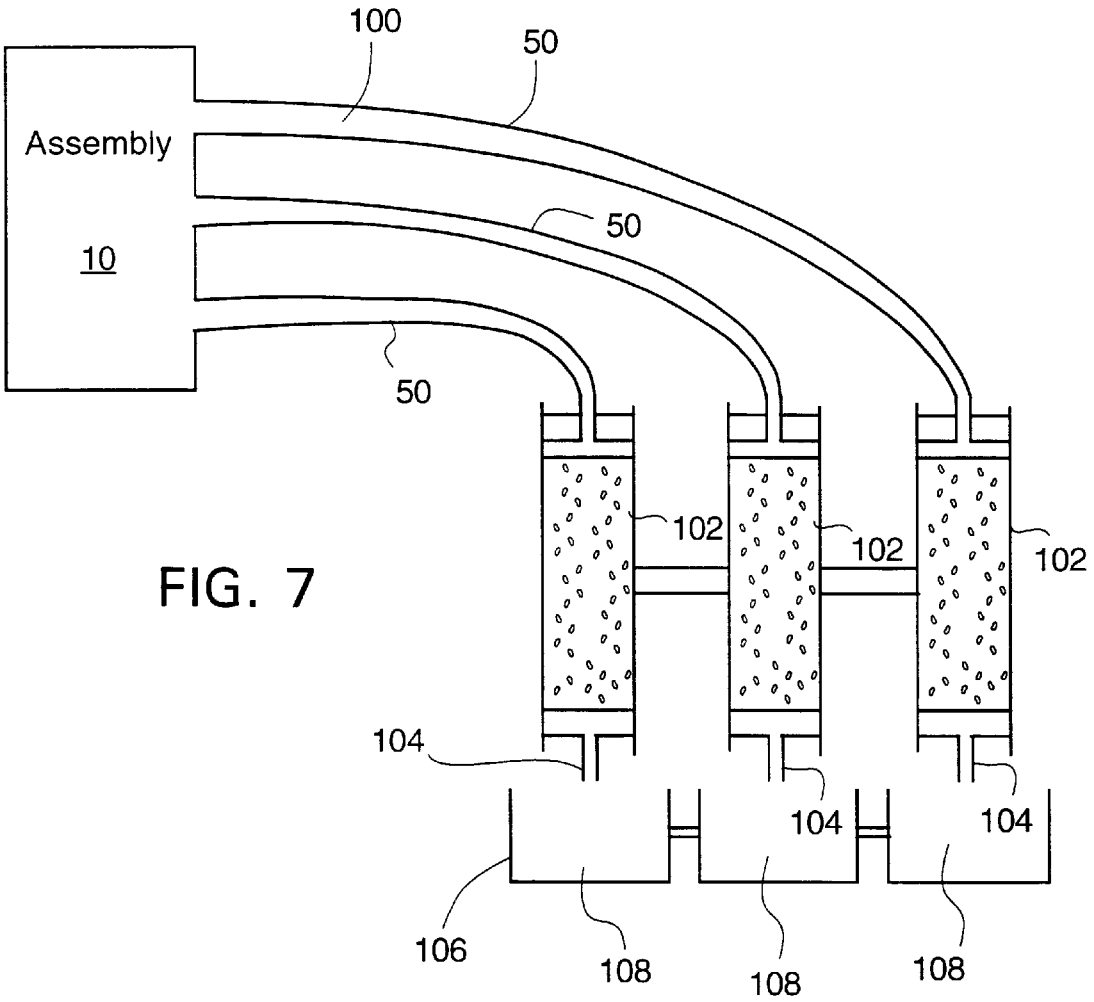
FIG. 7 is a schematic showing the FIG. 1 pump assembly connected to pump fluid to a series of chromatography columns connected in parallel and a fraction collector.

Referring to FIG. 7, preferably pump drive assembly 10 is used to supply mobile phase liquid 100 to a plurality of chromatography columns 102 connected in parallel. The outlets 104 of the chromatography columns 102 are connected to a fraction collector 106 to collect sequential samples 108 from each column 102. (See, e.g., U.S. patent application Ser. No. 09/264,846, entitled "Cartridge Sealing Apparatus and Method," filed the same date as this application, and incorporated herein by reference; that application describes sealably connecting a plurality of chromatography columns.) If there is a clog in one column or associated flow line, the associated pump will decouple, while fluid continues to be safely supplied at the appropriate pressure and desired volume to the remaining columns. The arrangement thus avoids leaks and potential damage that might occur in the absence of the decoupler. In addition, by having parallel flow with individual pistons, the possible problem of directing too much flow to any one chromatography column is avoided.

Other embodiments are within the scope of the claims. For example, the user can vary the attractive force between magnets 20 and plate 22 by varying the magnets, varying the material of the plate, or using a nonmagnetically attracted spacer between magnet 20 and plate 22. Magnets having an attractive force to iron of, e.g., 10–100 pounds (most preferably 30–70 pounds) can be used. For a given operation of apparatus 10, a user generally employs the same decoupling force for each channel, though it is possible to employ, e.g., 30 pound magnets for some pumps, 40 pound magnets for others, and 70 pound magnets for yet others. The plate material can be any magnetizable material, such as iron, some stainless steels (e.g., 17–4 or 440*c*), another metal or mixture of metals, or a ceramic mixed with a magnetizable material, such as a metal. The magnets can also be electromagnets rather than permanent magnets.

Figure 5A:
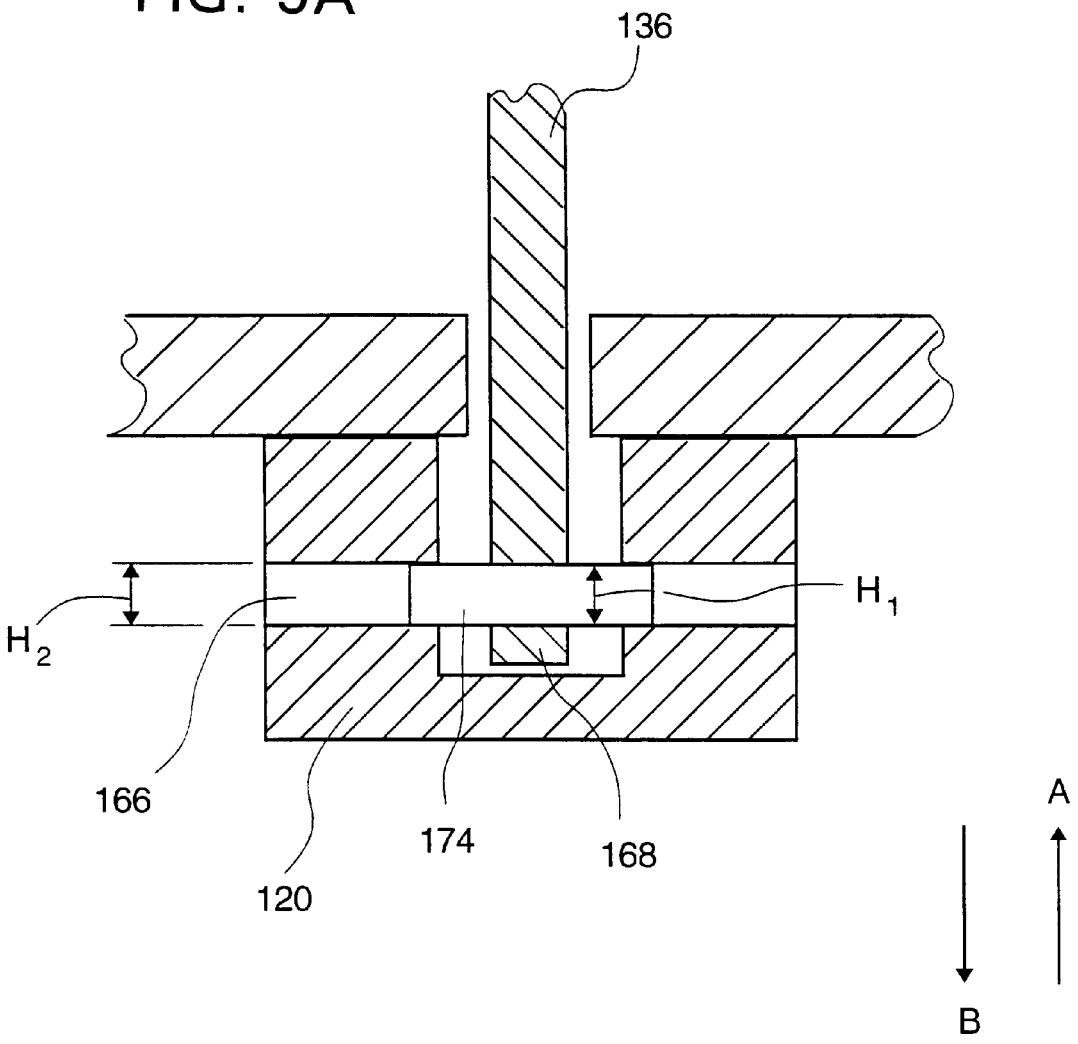
FIGS. 5A and 5B are an enlarged sectional views of alternative attachment structures for the decoupler of FIG. 4.

Magnets 20 can be coupled to rods 36 using structure other than a retaining ring. For example, referring to FIG. 5A, a magnet 120 has an opening 166. Attached to a piston rod 136, near a base 168 of rod 136, is a pin 174. Pin 174 is sized and shaped to be insertable within opening 166. Pin 174 has a height H, approximately equal to a height $H_2$ of opening 166, so that pin 174 fits snugly within opening 166. Pin 174 holds piston rod 136 to magnet 120. In operation, pin 174 will transmit the resistive force experienced by a piston head (not shown) to magnet 120, rather than the rod shelf 69 in the embodiment discussed above.

Figure 5B:
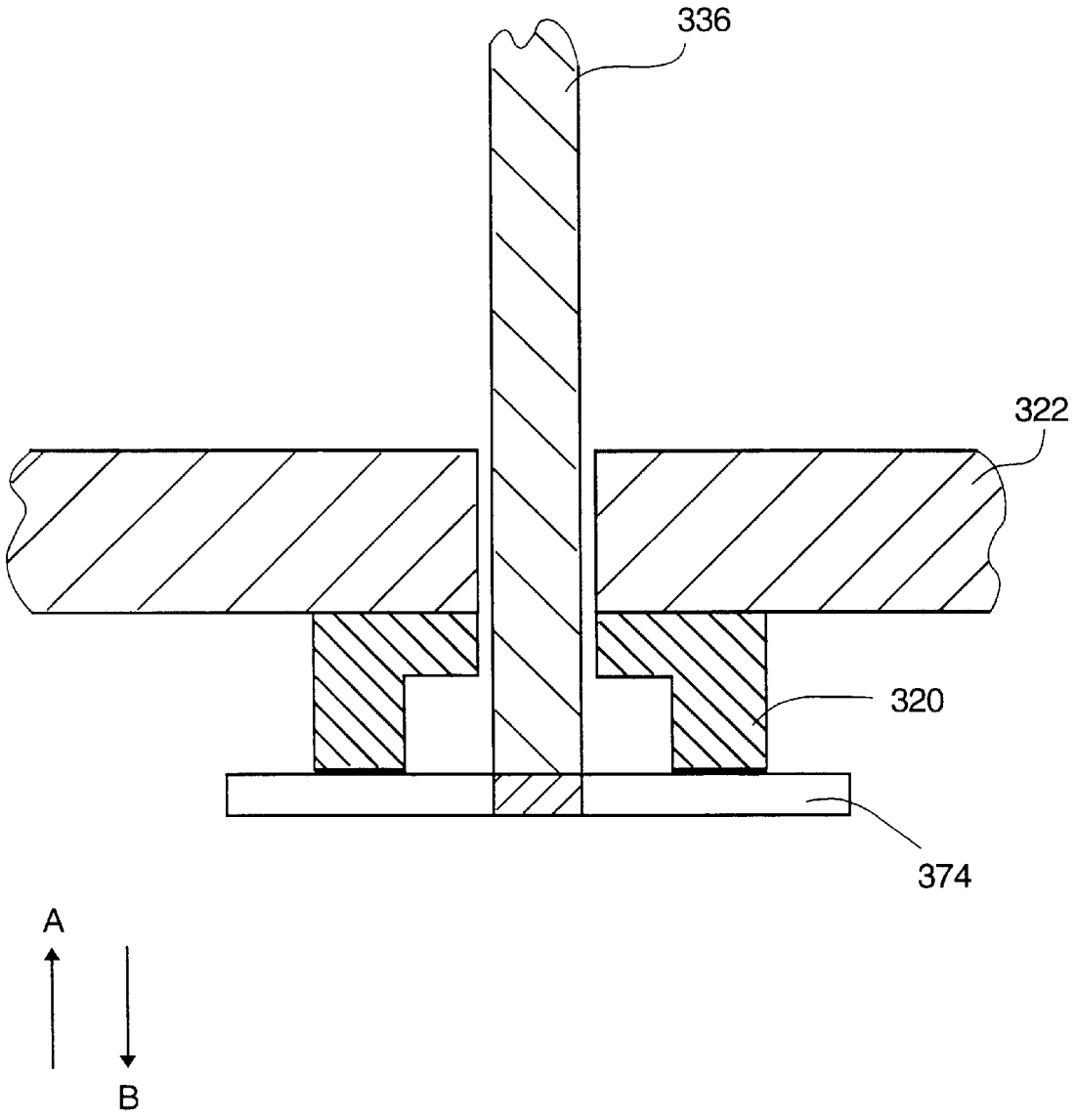

Alternatively, the magnets can be permanently connected to the plate and coupled by magnetic force to a magnetizable disk. Referring to FIG. 5B, a magnet 320, facing the opposite direction as magnets 20 and 120, is permanently connected to a plate 322. A piston rod 336 passes through both plate 322 and magnet 320, and connects to a magnetizable disk 374. The magnetizable disk 374 couples to magnet 320. In operation, disk 374 is held by magnets 320 unless there is a separation force between magnet 320 and disk 374 that exceeds the magnetic coupling force.

Assembly 10 can have greater or fewer than twelve pumps. For example, assembly 10 might have only one pump, rather than a circular array of twelve pumps. The pumps can all be connected to the same fluid destination, or to a few fluid destinations, rather than to twelve separate fluid destinations. The pumps can gather liquid from different fluid sources rather than from a single fluid source. Different pumps can be set to gather different volumes of fluid for a given operation of assembly 10, e.g., by constructing different pumps 16 to have pump cylinders 32 with different diameters. In addition, the pumps need not employ pistons to deliver liquid from source 12 to destinations 14. For example, the pumps can employ diaphragms. The pumps also need not be fluid pumps. For example, the pumps might deliver gasses from a gas source to a gas destination.

Driver 18 need not employ a pneumatic drive. For example, driver 18 might include an electric motor drive, a hydraulic drive, or other drive system.

Figure 6:
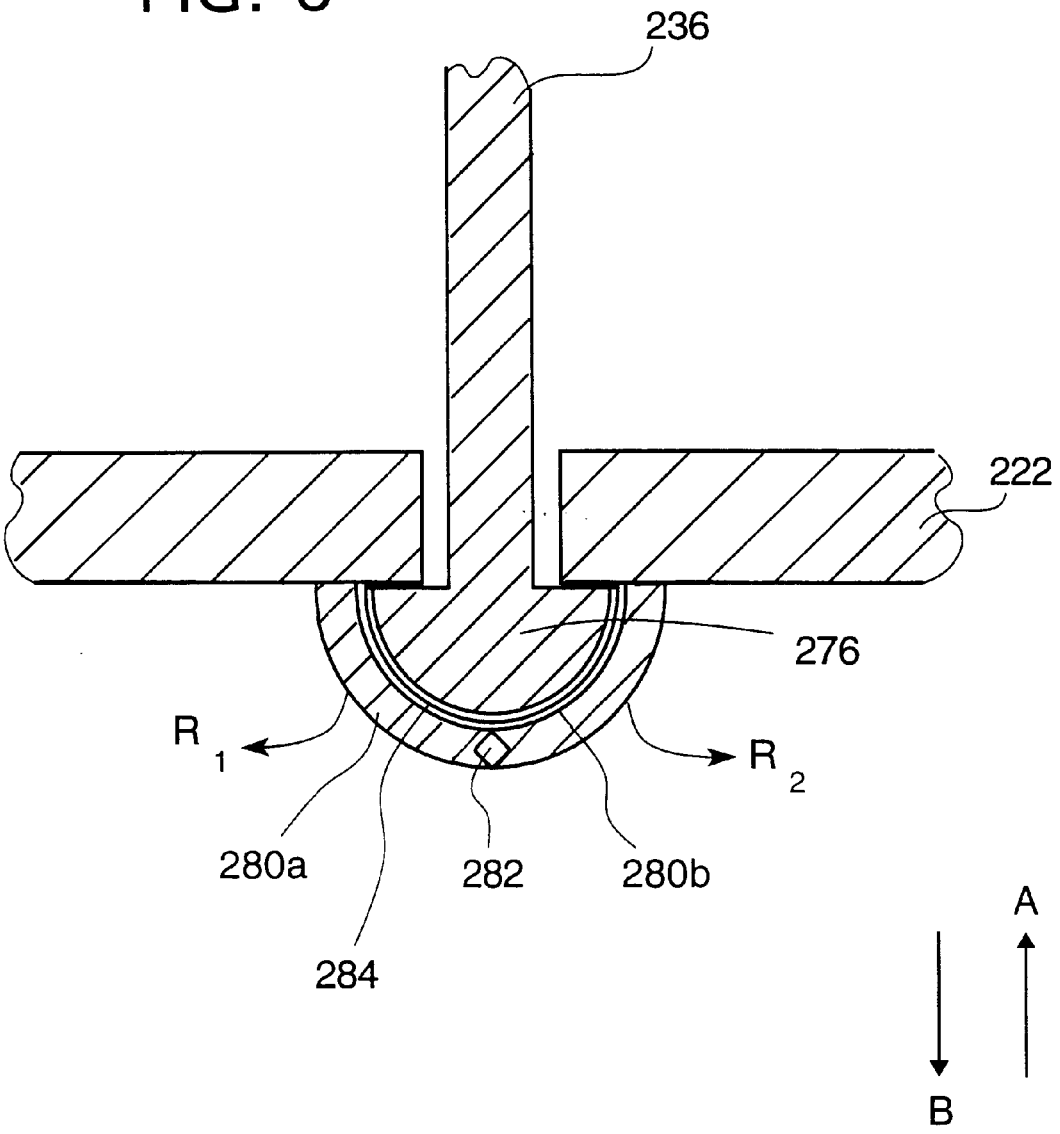
FIG. 6 is an enlarged sectional view of a decoupler of an alternative embodiment of the assembly of FIG. 1.

In addition, a decoupler other than magnets can be used to decouple the pump driving member from the driver when a resistive force exceeds a predetermined level. For example, a decoupler might be attached to plate 22 using hook and loop fasteners, rather than magnetic attraction. Alternatively, the decoupler might include two pieces which releasably latch together. Referring to FIG. 6, a rod 236 has a mushroom shaped end 276. End 276 is held in contact with a plate 222 by curved arms 280*a*, 280*b*. Curved arms 280*a*, 280*b* are rotatable in the directions of arrows $R_1$ and $R_2$, respectively. Curved arms 280*a*, 280*b*, are joined together by coupling structure 282 (shown schematically in FIG. 6). Coupling structure 282 can attach arm 280*a* to arm 280*b* using, e.g., a releasable mechanical latch, an electromagnet, a permanent magnet, or other suitable device. In operation, as a pump (not shown) pumps fluid to a destination source (not shown), a round face 284 of end 276 will exert a force upon arms 280*a*, 280*b* in the direction of arrow B. If the force exerted by round face 284 upon arms 280*a*, 280*b* exceeds a predetermined level, e.g., 70 pounds, latch 282 will release, and the pump will stop pumping liquid, as described above with reference to FIGS. 1–4.

In addition, the decoupler can employ a sturdy material which engages a deformable material, such as a "ball and socket" connection. Referring again to FIG. 6, rather than latching arms 280*a*, 280*b* together using latch 282, arms 280*a*, 280*b* can be constructed from a deformable material, such that arms 280*a*, 280*b* bend generally in the direction of arrows $R_1$ and $R_2$ respectively, releasing end 266, when the force exerted by end 266 upon arms 280*a*, 280*b* exceeds a threshold level.

The decoupler can also employ one or more springs. The springs might be biased such that they exert a force upon a piston rod which couples the rod to the plate. When the resistive force acting upon the piston exceeds the force exerted by the biased springs, the rod would decouple from the plate.

Additional modifications of apparatus 10 are within the scope of the claims.

What is claimed is:

1. A pump drive assembly comprising:

a driver;

a plurality of drive members that are driven by said driver;

a plurality of pumps driven by respective said drive members; and a plurality of decouplers, each decoupler separately decoupling a respective said drive member from said driver when a force exerted upon said respective drive member exceeds a threshold force.

2. The assembly of claim 1, wherein said pumps comprise positive displacement pumps.

3. The assembly of claim 2, wherein said pumps comprise piston heads, and said drive members comprise piston rods.

4. The assembly of claim 1, further comprising a decoupler attachment structure, wherein said decoupler attachment structure is driven by said driver, and said decouplers are coupled to said decoupler attachment structure.

5. The assembly of claim 4, wherein each said decoupler comprises a magnet, and said decoupler attachment structure comprises a material magnetically attracted to said magnets.

6. The assembly of claim 5, wherein said material is selected from the group consisting of iron, stainless steel, steel, and a ceramic comprising a magnetizable material.

7. The assembly of claim 5, wherein each said magnet defines a bore, respective said drive members are constructed to be insertable within respective said bores, and each said drive member includes a retaining structure that retains said respective drive members within said respective bores.

8. The assembly of claim 7, wherein each said retaining structure comprises a retaining ring having a diameter greater than a dimension of its respective said bore.

9. The assembly of claim 7, wherein each said retaining structure comprises a pin having a dimension greater than a dimension of its respective said bore.

10. The assembly of claim 5, wherein each said decoupler attachment structure is attracted to its respective magnet by a magnetic force between about 30 and 70 pounds.

11. The assembly of claim 10, wherein said plate has a first surface closer to said driver, and a second surface further from said driver, said magnets are attached to said second surface, and said plate defines a plurality of holes for passage of said drive members therethrough.

12. The assembly of claim 10, wherein said magnetizeable members comprise metal disks.

13. The assembly of claim 1, further comprising:

a plate driven by said driver; and a plurality of magnets attached to said plate, wherein each decoupler comprises a magnetizeable member attached to a respective said drive member and magnetically coupled to a respective said magnet, each magnetizeable member decoupling from its respective said magnet when said force exerted upon said respective drive member exceeds said threshold force.

14. The assembly of claim 1, wherein each said decoupler comprises a first piece, a second piece, and a coupling structure which releasably attaches said first piece to said second piece, wherein a respective said coupling structure releases when said force exerted upon a respective said drive member exceeds said threshold force.

15. The assembly of claim 1, wherein said pumps are positive displacement pumps that displace fluid, and said forces exerted upon said drive members comprise forces exerted by said displaced fluid upon said positive displacement pumps.

16. A pump assembly comprising:

a driver;

a plurality of pumps, each said pump including a drive member and a pumping member driven by said drive member;

a plate comprising a magnetizable material, said plate driven by said driver;

a plurality of magnets, each said magnet coupled to said plate by magnetic force, and each said pump drive member having structure for coupling to a respective said magnet;

wherein a respective said magnet decouples from said plate when a force resisting movement of said drive member exceeds a threshold force.

17. A pump drive assembly comprising:

a driver;

a pump drive member driven by said driver; a decoupler that decouples said drive member from said driver when a force acting on said drive member exceeds a threshold force, wherein said decoupler comprises a deformable structure and said deformable structure deforms when said force acting upon said drive member exceeds said threshold force, decoupling said decoupler from said drive member.

18. A method of ceasing one of a plurality of pumping operations upon exceeding a threshold resistance to said one pumping operation, the method comprising:

providing a driver, a plurality of pump drive members driven by said driver, a plurality of decouplers coupling said pump drive members to said driver, and a plurality of pumps driven by respective said pump drive members;

pumping fluids in said pumps by said driver and drive members so long as pressure in said fluids pumped by said pumps is below a threshold value, and decoupling a said decoupler from said driver when pressure in a said fluid exceeds said threshold value.

19. The method of claim 18, wherein said pumps include pistons, and said drive members are piston rods.

20. The method of claim 18, wherein said fluid is mobile phase liquid for chromatography, and the method further comprises directing said liquid through respective chromatography columns.

21. The method of claim 20, further comprising directing liquid from said chromatography columns to a fraction collector.

22. The method of claim 18, further comprising continuing pumping at pumps whose associated drive members have not been decoupled.

* * * * *